United States Patent [19]

Rudichuk

[11] 4,091,585

[45] May 30, 1978

[54] CONCRETE-FILLED, BLOCK AND TIE WALL BUILDING SYSTEM

[75] Inventor: John Rudichuk, Calgary, Canada

[73] Assignee: Speed-Form Manufacturing Ltd., Canada

[21] Appl. No.: 728,506

[22] Filed: Oct. 1, 1976

Related U.S. Application Data

[63] Continuation-in-part of Ser. No. 528,575, Nov. 29, 1974, which is a continuation of Ser. No. 290,737, Sep. 20, 1972, abandoned.

[51] Int. Cl.[2] ..... E04B 1/00

[52] U.S. Cl. ..... 52/274; 52/275; 52/279; 52/564; 52/565; 52/568

[58] Field of Search ..... 52/562, 564, 568, 426, 52/275, 279, 274, 424, 425, 563, 427, 565

[56] References Cited

U.S. PATENT DOCUMENTS

| | | | |
|---|---|---|---|
| 1,053,231 | 2/1913 | Schweikert | 52/562 |
| 1,753,451 | 4/1930 | Tonnelier | 52/564 |
| 2,014,315 | 9/1935 | Egloff et al. | 52/424 X |
| 2,029,082 | 1/1936 | Odam | 52/275 |
| 2,181,698 | 11/1939 | Langenberg | 52/564 X |
| 2,261,510 | 11/1941 | Atcheson | 52/425 X |

FOREIGN PATENT DOCUMENTS

| | | | |
|---|---|---|---|
| 1,103,549 | 2/1959 | Germany | 52/426 |

*Primary Examiner*—Ernest R. Purser
*Assistant Examiner*—Carl D. Friedman
*Attorney, Agent, or Firm*—Cushman, Darby & Cushman

[57] ABSTRACT

A footing is poured with an inner row and an outer row of upwardly projecting tie legs set therein. An inner course and an outer course of blocks having appropriate downwardly opening sockets are respectively placed on the footing, with the tie legs being received in those sockets. The blocks also have upwardly opening sockets. Downwardly projecting legs of H-shaped ties are mounted in those sockets, each tie uniting an inner block and an outer block in the same course. The upwardly projecting legs of these H-shaped ties then receive the downwardly opening sockets of the next upper inner and outer courses of blocks, and so on until the desired number of block courses are in place. No mortar is used in setting the first course on the foundation or in setting each succeeding course. However, when the courses are in place, concrete or equivalent settable composition is poured in the space between the inner and outer block rows to fill the space and thus create an integral wall. Special block constructions for erecting wall corners are also provided.

6 Claims, 6 Drawing Figures

CONCRETE-FILLED, BLOCK AND TIE WALL BUILDING SYSTEM

REFERENCE TO RELATED APPLICATION

This application is a continuation-in-part of my earlier copending application Ser. No. 528,575, filed Nov. 29, 1974 which is a Continuation of Ser. No. 290,737, filed Sept. 20, 1972, and abandoned in favor hereof.

BACKGROUND OF THE INVENTION

Prior art proposals for building walls of blocks with and without mortar between courses, ties between courses and blocks, and cement poured into the interior exist with many variations, exemplified by those shown in the following U.S. patents.

| Patentee | Pat. No. | Issue Date |
|---|---|---|
| Pride | 430,810 | June 24, 1890 |
| Kidder | 742,094 | October 20, 1903 |
| McClure | 781,344 | February 7, 1905 |
| Anderson | 802,903 | October 24, 1905 |
| Layfield et al | 836,589 | November 20, 1906 |
| Olafson | 1,404,473 | January 24, 1922 |
| Odam | 2,029,082 | January 28, 1936 |
| Pinney | 2,228,363 | January 14, 1941 |
| Atcheson | 2,261,510 | November 4, 1941 |
| Jacobson | 2,326,361 | August 10, 1943 |
| Reichert et al | 2,366,572 | January 9, 1945 |
| Westveer | 2,372,038 | March 20, 1945 |
| Johnson et al | 2,383,317 | August 21, 1945 |
| Adelt | 2,821,850 | February 4, 1958 |
| Brouk | 2,825,221 | March 4, 1958 |
| Wilson | 2,921,462 | January 19, 1960 |
| Wood | 3,238,684 | March 8, 1966 |
| Kustusch | 3,562,991 | February 16, 1971 |
| Novoa | 3,603,052 | September 7, 1971 |
| Frati | 3,676,967 | July 18, 1972 |
| Wood | 3,717,967 | February 27, 1973 |

However the fact remains that none of these constructions have captured much of the block wall market. It can be postulated that although elements exist which could be abstracted from the prior art to synthesize a construction that would be successful, so far the right combination has eluded those skilled in the art.

SUMMARY OF THE INVENTION

The present invention endeavors to provide a masonary block wall construction system that can be erected at reasonable cost with largely unskilled labor, yet have an attractive uniform appearance, be stable and sound, and a system that can be practiced on a small scale or a large one.

A footing is poured with an inner row and an outer row of upwardly projecting tie legs set therein. An inner course and an outer course of blocks having appropriate downwardly opening sockets are respectively placed on the footing, with the tie legs being received in those sockets. The blocks also have upwardly opening sockets. Downwardly projecting legs of H-shaped ties are mounted in those sockets, each tie uniting an inner block and an outer block in the same course. The upwardly projecting legs of these H-shaped ties then receive the downwardly opening sockets of the next upper inner and outer courses of blocks, and so on until the desired number of block courses are in place. No mortar is used in setting the first course on the foundation or in setting each succeeding course. However, when the courses are in place, concrete or equivalent settable composition is poured in the space between the inner and outer block rows to fill the space and thus create an integral wall. Special block constructions for erecting wall corners are also provided.

The principles of the invention will be further discussed with reference to the drawing wherein preferred embodiments are shown. The specifics illustrated in the drawing are intended to exemplify, rather than limit, aspects of the invention as defined in the claims.

BRIEF DESCRIPTION OF THE DRAWING

IN THE DRAWING

Figure 1:
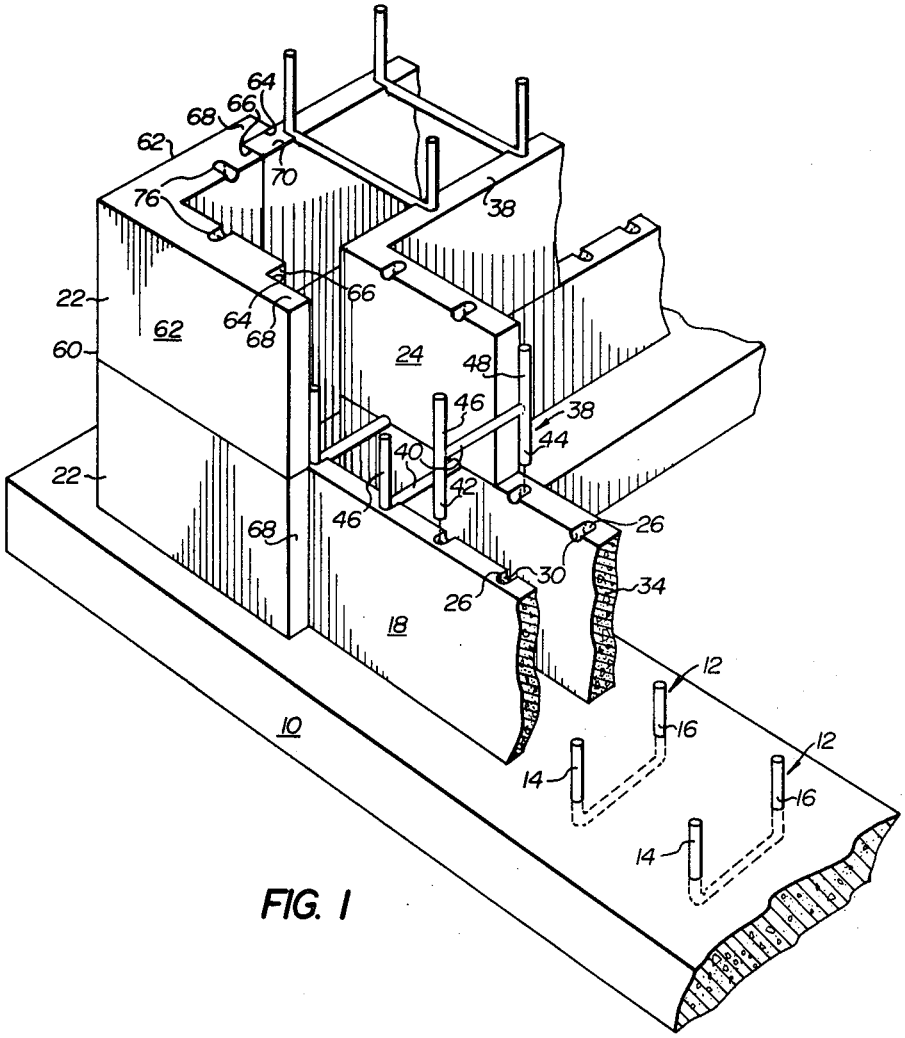
Figure 3:
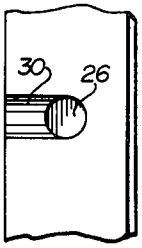
Figure 4:
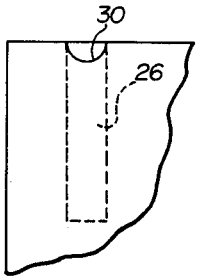
Figure 2:
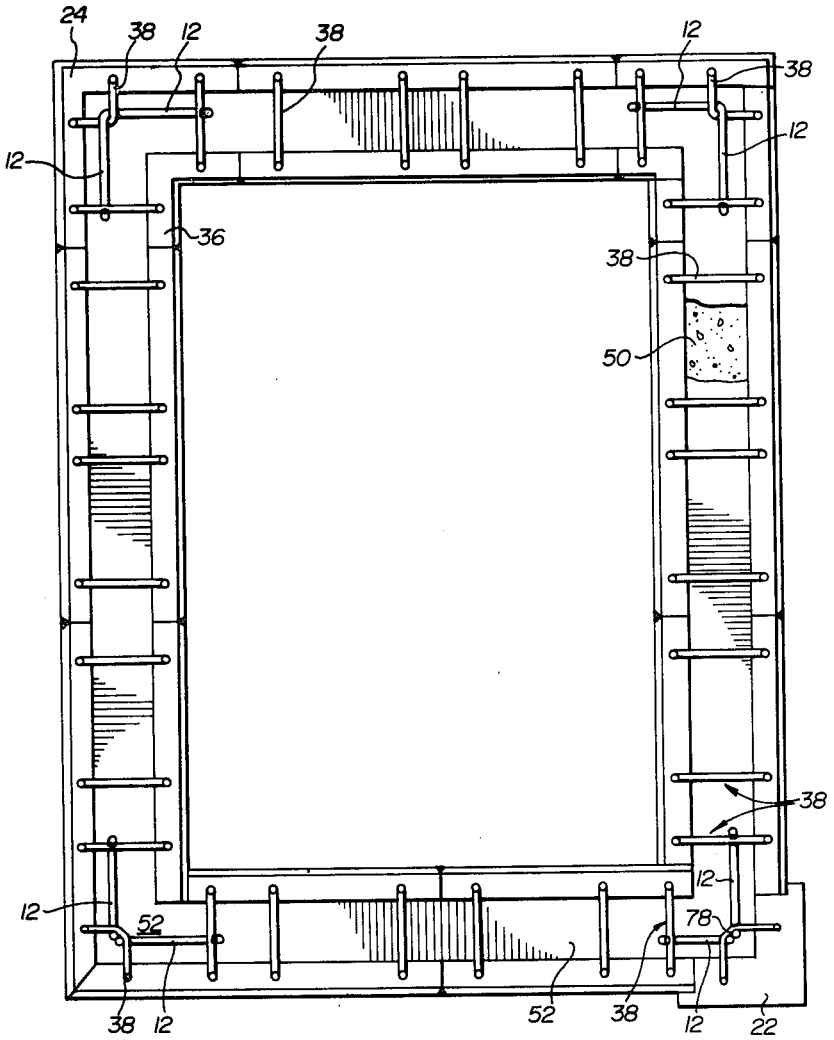

FIG. 1 is a fragmentary perspective view of a wall system under construction in accordance with the present invention;

FIG. 2 is a top plan view thereof;

FIG. 3 is a fragmentary top plan view of an exempliary block, on a larger scale; and FIG. 4 is a fragmentary rear elevation view thereof.

Figure 5:
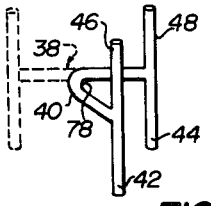
Figure 6:
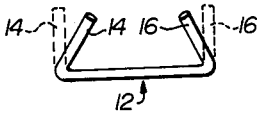

FIG. 5 is a perspective view illustrating the way an H-shaped tie is bent for use at a corner; and FIG. 6 is a perspective view illustrating the way a U-shaped tie is bent for use at a corner.

DETAILED DESCRIPTION OF A PRESENTLY PREFERRED EMBODIMENT

In a preferred practice of the invention, a footing 10 is laid with U-shaped ties 12 set at regular intervals therein, to provide an outer row of vertically upwardly projecting tie legs 14 and an inner row of vertically upwardly projecting tie legs 16.

The U-shape hooks (12) need not necessarily be embedded in the footing course (10). One can appreciate that one would have to be very exact in embodying these U-hooks in the footing course and it is not always essential that one has this "firmness" at the bottom with respect to each block. It may be that the wall is "anchored" to the footing course by other means so that the U-hooks sit unembedded on the footing course. One possible method of anchoring the wall to the footing course would be to have, between the side pads, a channel 4 inches wide and 2 inches deep, for example, formed when the footing course is laid, so that the concrete when it is poured into the form goes down into this channel thereby preventing movement laterally after the concrete is set. Another alternative would be to periodically have steel rods coming out of the footing course against which the inner and outer pads would be placed.

Next a first course of outer blocks 18 include straight blocks 20 and corner blocks 22, 24. In each instance, at regularly spaced sites there are downwardly opening sockets 26 formed in the lower edges 28 of the blocks 18 intermediate the thickness thereof. A channel 30 is formed in each lower edge 28 at the site of each socket 26, leading from the socket mouth transversally to the inner face 32 of the block. The construction of the socket 26 and the channel 30 is shown in more detail in FIGS. 3 and 4.

Likewise, a first course of inner blocks 34 is slipped over the tie legs 16. The blocks 34 include straight blocks 20 and corner blocks 36, 38.

All of the blocks 18 and 34 look the same if inverted, there being no right-side-up. Accordingly, there are upwardly opening sockets 26 formed in the upper edges 28 of the blocks 18, 34 intermediate the thickness thereof. A channel 30 is formed in each upper edge 28 at the site of each socket 26, leading from the socket mouth transversally to the inner face 32 of the block.

When the inner and outer first courses are in place, there will be pairs of sockets 26 each consisting of a socket 26 in the upper edge of a block 18 and a socket 26 in a block 34, transversally spaced from one another and with respective channels 30 projecting towards one another in axial alignment.

The next-installed component of the system are H-shaped ties 38. Each H-shaped tie 38 includes a horizontal cross bar 40, an outer vertically downwardly projecting leg 42, an inner vertically downwardly projecting leg 44, an outer vertically upwardly projecting leg 46 and an inner vertically upwardly projecting leg 48.

Each H-shaped tie is assembled to a respective pair of sockets 26 in the upper edges of the blocks of the first course by inserting the leg 42 in the upwardly opening socket 26 of an outer block 18 and inserting the leg 44 of the same tie in the upwardly opening socket 26 of the corresponding inner block 34.

When the ties 38 are in place, second courses of inner and outer blocks are slipped onto the upwardly projecting tie legs 46 and 48 in the same manner as was described for slipping the blocks of the first courses onto the respective tie legs 14, 16. Thus the blocks of the second courses are merely stacked upon the blocks of the first courses, without intervening mortar.

These steps are alternated, with ties and blocks being installed in alternation until the uppermost courses of blocks are stacked in place. Then a set of U-shaped ties 12 is inverted and installed in the sockets 26 in the upper edges of the uppermost courses. In all instances the tie cross bars 40 proceed transversally of the wall, uniting the blocks 18 of the outer courses to the blocks 34 of the inner courses. The cross bars 40, near all the vertical tie legs nestle in the channels 30.

A somewhat different tie situation pertains at the corners. There, irrespective of whether the corner is assembled from butted, lapped or mitered straight blocks, or flush or overlapped corner blocks, the following arrangement is installed. An H-shaped tie 38 is bent about an axis parallel to its legs 42-48 until the cross bar 40 is somewhere between L-shaped and C-shaped (FIG. 5). The legs 42 and 44 are inserted in those two sockets 26 of the outer block or blocks which are closest to the juncture 76 at the corner. This provides a loop 78 which projects into the space 52 between the inner and outer block courses. Then, a first U-shaped tie 12 is placed in the space 52 and its legs 14 and 16 are respectively hooked about the loop 78 and the cross bar 40 of the nearest H-shaped tie 38 on one side of the corner. The legs 14 and 16 of that tie 12 are then bent over, to assume much the shape of a crimped staple. (See FIG. 6). Likewise, a second U-shaped tie 12 is placed in the space 52 and its legs 14 and 16 are respectively hooked about the loop 78 and the cross bar 40 of the nearest H-shaped tie 38 on the opposite side of the corner. The legs 14 and 16 of that tie 12 are then bent over as in FIG. 6. The net effect is to draw the corner in tightly and secure the bent H-shaped tie firmly to the nearest non-bent H-shaped ties to the left and right of the corner.

Of course, the downwardly open sockets 26 of the outer corner block or blocks of the next-upper course receive the legs 46, 48 of the bent H-shaped tie 38.

Finally, mortar, concrete 50 or other settable composition (such as foaming plastic material) is poured into the space 52 between the inner and outer multi-course block rows and permitted to set, thus uniting the stacked blocks and received ties into an integral wall.

While it is true that in some walls where certain strength requirements are necessary the material poured between the side members will consist of concrete or other material that is allowed to set, it is not, however, essential in all cases that the material that will be placed between the side pads will be such so as to require "setting." In walls where no particular strength requirement is necessary the material in the centre could consist of paper, sand or other material. It is possible that in certain portions of the wall that will be strengthbearing there may be columns of concrete which are allowed to set with the intervening space between the columns filled with non-setting material. It is not always essential to the system that the material poured between the side members will "set" or "bond" to the side pads or members.

Note that the space 52 is substantially continuous within the wall, so that pouring the concrete 50 is simplified — it tends to flow along the space until the space 50 is filled to the top.

Where necessary, additional conventional reinforcing or anchoring may be provided to secure the blocks to the footing, to one another and to stiffen the wall against buckling.

Also where necessary braces and/or forms may be put in place temporarily at the wall ends, or around the door, or window openings or the like for keeping the concrete in the space 52 until it sets. Then the braces and/or forms may be removed.

Typically, each straight block 20 measures 35 $\frac{7}{8}$inches long × 10 inches high × 2 inches thick. There are typically four sockets 26 in each block edge 28, each $\frac{1}{4}$ inch diameter and at least 2 $\frac{1}{2}$ inches long, two being centered 2 15/16 inches from respective ends of the block and the other two being centered 6 inches apart 17 15/16 inches from respective ends of the block. Typically, each vertical tie leg is 2 $\frac{1}{2}$inches long and each cross bar is 8 $\frac{1}{2}$ inches long.

FIGS. 1 and the lower right hand corner shown in FIG. 2 highlight a preferred corner block 22, having a vertical axis 90° corner 60 between two mirror-image sections 62. Typically, the block 22 measures 12 $\frac{3}{4}$ inches long along the outside of each section and 9 inches long along the inside of each section. This block is also 10 inches high, but is an extra inch thick on the outside, thus creating a vertical channel 64 at the outer end inner corner of each section of the block 22. Typically each channel 64 measures $\frac{3}{4}$ inch along the length of the block and two inches along the thickness of the block, and is of rectangular transverse cross-section.

The sockets 26 are located in the upper and lower edges of the block 22 with reference to the inner face of the block 22, so it may be connected to other blocks using H-shaped and U-shaped ties of the same size used amoung the other blocks.

Thus, another way of looking at the blocks 22 is that they are backed with a typically one inch thick portion that extends $\frac{3}{4}$ inch beyond what would otherwise be the block ends at 66. These extensions 68 can be thought of as keeper flanges, since when the blocks are coursed, the ends 70 of the adjacent straight blocks abut the ends 66 of the blocks 22 in the respective course and the keeper flanges 68 overlap those adjacent straight blocks for bands extending $\frac{3}{4}$ inch along the block length. This considerably strengthens the corners, normally sites of greater stress concentration curing the pouring and setting of the concrete.

While a particular sizes of blocks, ties, etc., have been described, there is no requirement for the blocks to be 2 inches thick. If the material is strong enough they could be an inch thick, and so on. Generally there are four sockets in each block, in the case of half blocks there are only two sockets. The sockets under discussion need not be ¼ inch in diameter but merely need be large enough to receive the legs of the H-hook which may or may not be ¼ inch in diameter.

Likewise, it is not essential that the depth of the socket be 2 ½ inches. It may be found that sufficient tie characteristics are obtained using 1 ½ inch socket and corresponding H-hook ties. By the same token, the cross-bar of the H-hook necessarily need not be 8 inches long. The length of the cross-bar is solely dependent upon the width of the desired wall. If one wanted to have a 10 inch wall overall and the sockets were placed in the middle of the side pads, the H-hook cross-bar would be 8 inches long so that one had 1 inch plus 8 inches plus 1 inch to give a 10 inch overall wall.

If one wanted a 15 inch wall then on the same reasoning the cross-bar would be 13 inches long. If one wanted a 5 inch wall the cross-bar would be 3 inches long. If the channels are not perfectly centred then this would increase or decrease appropriately the length of the cross-bar. This is one of the important features of the described system in that one can accommodate any thickness of wall merely by increasing or decreasing the length of the cross-bar. The same general comments apply to distances for corner blocks, the length of the channels (64) and so on. In other words, the disclosed system is very flexible and can be varied depending on the strength of the wire used, the strength of the wall required and other criteria.

In similar vein, the particular form of corner construction need not be 10 inches high, but can be any multiple of 10 inches high. If one had a 60 inch wall one could have a corner with the flanged edges extending the entire 60 inches. Or alternatively, one could have two separate pieces each 30 inches long. In this situation one would merely embody in the inner corner appropriate wire to receive the ties shown in FIGS. 6 at every 10 inch interval. It is not essential, therefore, with the flanged form of corner that it be the same width as the side pads so long as it is a multiple of the width of the side pads. This is not the case with respect to the other forms of corners as they must correspond to the width of the side pads.

Any of the three styles of corners shown at the top left, top right and lower left of FIG. 2 can also be used in the invention. These are alternatives to the corner design discussed in detail above. The corner style shown at the top left of FIG. 2 consists of two complementary molded right angle corner blocks 24 and 36. Block 36 is of smaller arm length because it is positioned on the inside corner.

The corner style shown at the top right is lapped. The corner laps can be formed by cutting normal blocks to size. The corner stype shown at the lower left consists of two outer sections which form a mitered corner and lapped internal corner members.

Any combination of the three alternative styles of corner construction can be normally used depending on materials on hand and what course is being laid. As each successive course of blocks is laid in position, a brick-type pattern is usually followed and hence some corners are at the end of full blocks while at other corners, half blocks must be used (See top right corner of FIG. 2). It is usually advisable for strength giving purposes to avoid having the same style of corner at each successive overlying course. In other words, a whole block at a corner should be placed on a half block, and a half block should be placed on a whole block, to ensure strength at the corner. Of course, good visual appearance of the corners is advisable and corner assemblies should be made with this objective in mind.

All of the three styles of corners are constructed so that the bend H-shaped ties 38 and crimped U-shaped ties 12 can be used in securing the corner members together.

The blocks can all be thought of as wall construction modules. By preference none of them have interdigitable tongues and grooves or the like on either their vertical end surfaces or their horizontal upper and lower surfaces. These clock surfaces all are preferably flat and merely abut the corresponding surfaces of adjacent blocks. Accordingly, much less block damage is experienced during shipping, since there are no tongues and grooves to break off.

The blocks are typically made of the same composition as conventional concrete blocks. The blocks can be reinforced with steel or the like for extra block strength. If steel reinforcing wire or rods are used, they should run in a horizontal direction and be positioned a certain distance under the channels 30, between the socket 26 and the face of the block to which the channel 30 leads. The reinforcing rod when placed in the described position helps to prevent the H-shaped ties from breaking away the portion of the block underlying the channel 30 when high pressures are exerted on the blocks. The exterior edges of the blocks can be bevelled to ease extraction from the block mold to improve the appearance of the visible surfaces of the wall by breaking the monotony of a solid continuous surface. The ties are typically made of the same steel or the like as conventional concrete reinforcing wire.

It should now be apparent that the filled, block and tie wall building system as described hereinabove, possesses each of the attributes set forth in the specification under the heading "Summary of the Invention" hereinbefore. Because the filled, block and tie wall building system can be modified to some extent without departing from the principles of the invention as they have been outlined and explained in this specification, the present invention should be understood as encompassing all such modifications as are within the spirit and scope of the following claims.

What is claimed is:

1. A filled block and tie wall building system comprising:

a footing;

an inner wall of generally thin cross section rectangular flat-ended, flat-edged vertically disposed precast concrete modules abutted flat end to flat end in each course and arranged in a plurality of superimposed courses in which lower edges of modules in upper courses abut upper edges of respective lower courses;

an outer wall of generally thin rectangular flat-ended, flat-edged vertically disposed precast concrete modules generally corresponding in size and shape to the modules of the inner wall abutted flat end to flat end in each course and arranged in a plurality of superimposed courses in which the lower edges of modules in upper courses abut upper edges of respective lower courses;

the inner and outer walls being transversally spaced in a parallel manner, with corresponding courses of each wall being at equivalent heights;

the lower edges of the lowermost courses of the modules being supported upon said footing;

means securing said lowermost courses to the footing to prevent lateral movement of the inner and outer walls with respect to the footing;

means defining at least two longitudinally spaced, upwardly opening apertures in the upper edge of each module;

means defining at least two longitudinally spaced, downwardly opening apertures in the lower edge of each module;

means defining two grooves in at least one of the upper and lower edges of each module, interconnecting the respective two apertures with the inner face of the respective module; and a plurality of H-shaped ties, each including: two, transversely spaced, vertically upwardly projecting legs; two, transversely spaced, vertically downwardly projecting legs; and a transversely extending cross bar;

the ties being assembled with the modules as follows: each tie having the two downwardly projecting legs thereof received in respective two of the upwardly opening apertures in the upper edges of two transversally spaced ones of said modules at equivalent heights; each respective tie having the two upwardly projecting legs thereof received in a respective two of the downwardly opening apertures in the lower edges of two transversally spaced ones of said modules in the next upper course at equivalent heights; and the transversally extending cross bar being received in a respective two of said grooves in a respective transversally spaced two of said modules; the inner and outer walls being characterized by the absence of mortar between the abutting ends and edges of adjacent modules in same inner wall and between the abutting ends and edges of adjacent modules in the same outer wall;

a poured and set filling of concrete or filling material substantially filling the space between the inner and outer walls and uniting the modules and ties into an integral wall; and wherein:

said integral wall exists in two portions disposed at a vertical axis right angle to one another, to provide a corner having an outside in one said wall and an inside in the other said wall;

an H-shaped tie bent partially double about a vertical axis intermermediate said cross-bar thereof, the two transversally spaced downwardly projecting legs of said bent H-shaped tie being received in the two of said upwardly opening apertures in the module upper edges which are nearest said corner to the left and right of said corner in said one wall in one course thereof and the two transversally spaced upwardly projecting legs of said bent H-shaped tie being received in the corresponding two downwardly opening apertures in the module lower edges in the next upper course of said one wall to provide a loop between the inner and outer walls at the corner;

a first U-shaped tie placed between said inner wall and said outer wall, said first U-shaped tie having two transversally spaced generally vertically projecting legs at opposite ends of a generally horizontally extending base, one of said legs of the first U-shaped tie being doubled hook-fashion through said loop and the other of said legs of the first U-shaped tie being doubled hook-fashion about the cross bar of the nearest of the first-mentioned H-shaped ties to the right of the corner; and a second U-shaped tie placed between said inner wall and said outer wall, said second U-shaped tie having two transversally spaced generally vertically projecting legs at opposite ends of a generally horizontally extending base, one of said legs of the second U-shaped tie being doubled hook-fashion through said loop and the other of said legs of the second U-shaped tie being doubled hook-fashion about the cross bar of the nearest of the first-mentioned H-shaped ties to the left of the corner.

2. The filled block and tie wall building system of claim 1, wherein:

said integral wall exists in two portions disposed at a vertical axis right angle to one another, with a column of outer corner blocks interposed in the outer wall to provide an outer corner, each outer corner block having a vertical axis apex at a right angle bend intermedite the ends thereof, the respective ones of said ends of the outer corner block abutting the adjacent ends of the adjacent modules of said two respective sections of said integral wall.

3. The filled block and tie wall building system of claim 1, wherein:

said corner blocks each extend further outwardly than said modules, thus providing an extra thickness portion on the exterior of each corner block; said extra thickness portion extending horizontally past the respective ends of the corner block to provide a vertical keeper flange flanking the outer extent of each end of the corner block; these keeper flanges abutting the outer faces of the adjacent modules of said two respective sections of said integral wall to strengthen the integral wall in the vicinity of said corner.

4. The filled block and tie wall building system of claim 1 wherein said means securing said lowermost courses to the footing is a longitudinal channel in the footing running between the inner and outer walls and adapted to receive said poured filling of concrete or filling material.

5. The filled block and tie wall building system of claim 1 wherein said means securing said lowermost courses to the footing is U-hooks embedded in the footing with the legs thereof extending vertically upwardly and being received in the apertures in the lower edge of each module.

6. The filled block and tie wall building system of claim 1 wherein said means securing said lowermost courses to the footing is a series of upwardly extending rods against which the inner and outer modules are placed.

* * * * *